US005305500A

United States Patent [19]

Tucker

[11] Patent Number: 5,305,500

[45] Date of Patent: Apr. 26, 1994

[54] BAG CLIP

[76] Inventor: Terence Tucker, P.O. Box 1420, San Juan Capistrano, Calif. 92693

[21] Appl. No.: 4,793

[22] Filed: Jan. 14, 1993

[51] Int. Cl.[5] ..... B65D 77/00; E05D 7/00

[52] U.S. Cl. ..... 24/30.5 R; 24/30.5 P; 24/543

[58] Field of Search ..... 24/489, 499, 543, 545, 24/517, 587, 67 R, 30.5 R, 30.5 P, 67.9, 542

[56] References Cited

U.S. PATENT DOCUMENTS

| | | | |
|---|---|---|---|
| 3,405,429 | 10/1968 | Vazquez | 24/543 |
| 3,616,497 | 11/1971 | Esposito, Jr. | 24/542 |
| 4,506,416 | 3/1985 | Ohminato et al. | 24/67 R |
| 4,514,885 | 5/1985 | Delahousse et al. | 24/543 |
| 5,179,768 | 1/1993 | Jio | 24/543 |

*Primary Examiner*—Victor N. Sakran
*Attorney, Agent, or Firm*—Stetina and Brunda

[57] ABSTRACT

A bag clip comprising first and second elongate jaw portions defining front and back ends and inner and outer surfaces. Extending between and interconnecting the first and second jaw portions intermediate the front and back ends thereof is a first spring portion which is operable to bias the front ends toward each other. The clip further comprises an elongate second spring portion which is attached to the front end of the second jaw portion and extends inwardly toward the first spring portion in cantilevered relation to the inner surface of the second jaw portion. The second spring portion is operable to bias the front end of the second jaw portion toward the front end of the first jaw portion.

9 Claims, 1 Drawing Sheet

BAG CLIP

FIELD OF THE INVENTION

The present invention relates generally to clamping devices, and more particularly to a clip for maintaining bags and similar articles in a closed state which is adapted to maintain its resiliency for prolonged periods of time.

BACKGROUND OF THE INVENTION

Currently, a number of prior art clamping devices are sold in the marketplace which are used for purposes of maintaining bags containing chips, pretzels and similar snack food items in a closed state after such food containment bags have been opened and only a portion of the contents consumed. One such prior art clamping device which is widely marketed under the trademark "CHIP CLIP" comprises a pair of jaw members which include handle portions formed thereon and are operatively connected to each other via a torsion wire spring. The spring biases the jaw members into abutting contact with each other, thus maintaining the bag in a closed state when the open end thereof is inserted between the jaw members. The compression of the handle portions of the jaw members toward one another overcomes the biasing force exerted by the spring, thus separating the jaw members and allowing the bag to be inserted or removed from therebetween.

Though this particular clamping device and others which are similarly structured are generally suitable for maintaining bags in a closed state, such devices possess certain deficiencies which detract from their overall utility. In this respect, the torsion wire spring typically incorporated into these prior art devices loses resiliency over time, thus allowing the device to be easily dislodged from the open end of the bag due to a decrease in the biasing force exerted by the spring. This loss of spring resiliency is accelerated when the jaw members are maintained in an open position for prolonged periods. Additionally, the materials used to fabricate the jaw members of the clamping device are prone to fatigue, and typically crack or completely rupture after repeated uses of the device. Further, due to the fabrication of these prior art clamping devices with independent jaw members interconnected by a separate torsion wire spring, the spring is oftentimes dislodged or disconnected from one or both of the jaw members, thus rendering the device unusable. Finally, since these prior art clamping devices incorporate only a single biasing member or spring, the biasing force exerted by the jaw members on the open end of the bag is limited, thus not ensuring that the bag is maintained in a tightly closed state. The present invention overcomes these and other deficiencies associated with prior art bag clamping devices by providing a bag clip incorporating a pair of biasing spring portions for added resiliency over prolonged periods of time.

SUMMARY OF THE INVENTION

In accordance with a preferred embodiment of the present invention, there is provided a bag clip comprising first and second elongate jaw portions defining front and back ends, and inner and outer surfaces. Extending between and interconnecting the first and second jaw portions intermediate the front and back ends thereof is a first spring portion which is configured to orient the front and back ends in juxtaposed relation and operable to bias the front ends toward and preferably into abutting contact with each other. Attached to the front end of the second jaw portion and extending inwardly toward the first spring portion in cantilevered relation to the inner surface of the second jaw portion is a second spring portion. In the preferred embodiment, the second spring portion is operable to bias the front end of the second jaw portion toward the front end of the first jaw portion. In utilizing the bag clip, the compression of the back ends of the first and second jaw portions toward each other is operable to overcome the biasing force exerted by the first spring portion, thus separating the front ends from each other, which are normally in abutting contact.

In the preferred embodiment, the first spring portion has an arcuate configuration and is bowed outwardly toward the back ends of the first and second jaw portions. Additionally, the juxtaposed back ends of the first and second jaw portions have arcuate configurations and are bowed inwardly toward each other. The back ends further include a plurality of laterally extending ribs formed on the outer surfaces thereof to aid in the gripping of the back ends, as well as a pair of reinforcing ribs extending along the inner surfaces thereof in opposed relation.

The bag clip constructed in accordance with the present invention further comprises a reinforcement portion formed on and extending along the inner surface of the first jaw portion in opposed relation to the second spring portion. The second spring portion defines a proximal portion which includes an extension formed on and extending upwardly therefrom, while the reinforcement portion defines a proximal portion including a detent forced therein. In the preferred embodiment, the detent is sized and configured to receive the extension when the front ends are biased toward and abutted against each other by the first and second spring portions of the clip. Additionally, the front ends of the first and second jaw portions are configured to allow the open end of the bag to be easily inserted therebetween. The clip is fabricated from polypropylene, though other materials may also be utilized.

BRIEF DESCRIPTION OF THE DRAWINGS

These as well as other features of the present invention will become more apparent upon reference to the drawings wherein.

DETAILED DESCRIPTION OF THE PREFERRED EMBODIMENT

Figure 1:
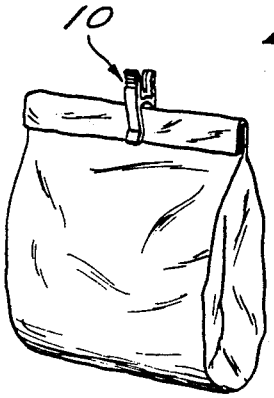
FIG. 1 is a perspective view of a bag as maintained in a closed state by the bag clip constructed in accordance with the present invention.
Figure 2:
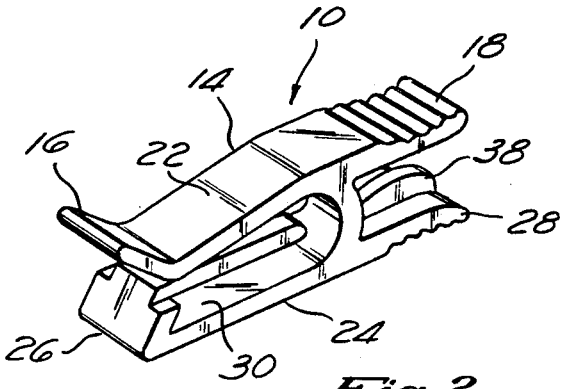
FIG. 2 is a perspective view of the bag clip.

Referring now to the drawings wherein the showings are for purposes of illustrating a preferred embodiment of the present invention only, and not for purposes of limiting the same, FIG. 2 perspectively illustrates a bag clip 10 constructed in accordance with the preferred embodiment of the present invention. The clip 10 is typically utilized to maintain the open end of a bag 12 or similar container in an overlapped or closed state, as seen in FIG. 1. The bag 12 with which the clip 10 is typically utilized contains large quantities of snack food products such as chips, pretzels and the like, wherein the entire contents of the bags are generally not immediately consumed, thus necessitating that the bag 12 be closed to maintain the freshness of the remaining quantity of the food product. However, it will be recognized that the clip 10 may be utilized in other applications, such as an alternative to a conventional clothes pin for maintaining articles of clothing upon a clothes line.

Figure 3:
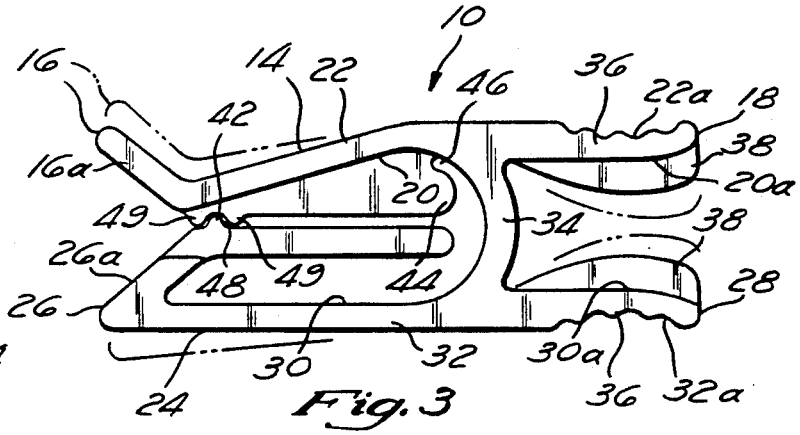
FIG. 3 is a side-elevational view of the bag clip shown in FIG. 2.

Referring now to FIGS. 2–5, the clip 10 generally comprises a first elongate jaw portion 14 defining a front end 16, back end 18, inner surface 20 and outer surface 22. The clip 10 further comprises a second elongate jaw portion 24 also defining a front end 26, back end 28, inner surface 30 and outer surface 32. Extending between and interconnecting the first and second jaw portions 14, 24 intermediate the front ends 16, 26 and back ends 18, 28 thereof is a first spring portion 34. In the preferred embodiment, the first spring portion 34 has an arcuate configuration and is bowed outwardly toward the back ends 18, 28 of the first and second jaw portions 14, 24. As best seen in FIG. 3, the first and second jaw portions are oriented on the opposed ends of the first spring portion 34 in a manner wherein the front ends 16, 26 and back ends 18, 28 thereof are disposed in juxtaposed relation. As can be appreciated, the first spring portion 34 is operable to normally bias the front ends 16, 26 of the first and second jaw portions 14, 24 toward and preferably into abutting contact with each other. In this respect, the selective compression of the back ends 18, 28 of the first and second jaw portions 14, 24 toward each other is operable to overcome the biasing force exerted by the first spring portion 34 and cause the front ends 16, 26 to separate from each other as shown in phantom in FIG. 3.

Figure 5:
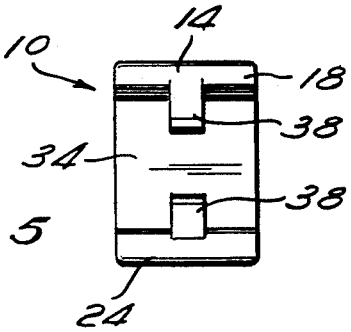
FIG. 5 is a rear-elevational view of the bag clip shown in FIG. 3.

To aid in the application of a compressive force to the back ends 18, 28 of the first and second jaw portions 14, 24, the back ends 18, 28 are each arcuately configured and bowed inwardly toward each other. Formed on and extending laterally across the outer surfaces 22*a*, 32*a* of the arcuate back ends 16, 26 are a plurality of ribs 36 which are adapted to further enhance the gripping of the back ends 18, 28 when a compressive force is to be applied thereto. Additionally, as best seen in FIGS. 3 and 5, formed on and extending along the inner surfaces 20*a*, 30*a* of the back ends 18, 28 is a pair of reinforcing ribs 38 which are disposed in opposed relation and are used to enhance the structural integrity of the back ends 18, 28. As will be recognized, the reinforcing ribs 38, due to their formation in opposed relation to each other, also limit the distance the front ends 16, 26 may be separated from each other. In this respect, when a compressive force is applied to the back ends 18, 28, the abutment of the reinforcing ribs 38 against each other prevents any further deflection of the first spring portion 34, thus preventing any additional separation of the front ends 16, 36. Importantly, the reinforcing ribs 38 are sized to prevent the first spring portion 34 from being deflected in an amount causing any rupturing, cracking or permanent deformation thereof.

Figure 4:
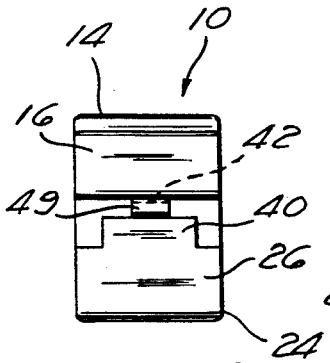
FIG. 4 is a front-elevational view of the bag clip shown in FIG. 3.

As seen in FIGS. 2 and 3, the second jaw portion 24 is formed in a manner wherein the front end 26 thereof is angled rearwardly toward the first spring portion 34. Formed on the rearwardly angled front end 26 of the second jaw portion 24 is an elongate second spring portion 40 which extends inwardly toward the first spring portion 34 in cantilevered, generally parallel relation to the inner surface 30 of the second jaw portion 24. In the preferred embodiment, the second spring portion 40 is operable to bias the front end 26 of the second jaw portion 24 toward the front end 16 of the first jaw portion 14. As best seen in FIG. 3, the second spring portion 40 defines a proximal portion adjacent the front end 26 of the second jaw portion 24 which includes an extension 42 formed on and extending upwardly therefrom. The use of the extension 42 will be discussed below. Additionally, as best seen in FIGS. 2 and 4, the width of the second spring portion 40 is slightly less than the width of the second jaw portion 24, with the proximal most end of the second spring portion 40 being continuous with the outer surface 26*a* of the rearwardly angled front end 26.

The clip 10 of the present invention further comprises a reinforcement portion 44 which is formed on and extends along the inner surface 20 of the first jaw portion 14 in opposed relation to the second spring portion 40. As seen in FIG. 3, the ends of the reinforcement portion 44 and second spring portion 40 disposed closest the first spring portion 34 have rounded configurations and do not extend beyond one another or contact the first spring portion 34. In this respect, the rounded end of the reinforcement portion 44 is defined by an arcuate notch 46 formed therein which prevents the same from interfering with the deflection and adversely affecting the resiliency of the first spring portion 34. The reinforcement portion 44 further includes a proximal portion having a detent 48 formed therein which is defined by a pair of projections 49 extending in parallel, spaced relation. In the preferred embodiment, the detent 48 is sized and configured to receive the extension 42 formed on the proximal portion of the second spring portion 40 when the front ends 16, 26 are biased toward each other by the first and second spring portions 34, 40. When the extension 42 is biased into the detent 48, each of the projections 49 is abutted against the second spring portion 40 along opposed sides of the extension 42. Since the second spring portion 40 is biased toward the reinforcement portion 44, the second spring portion 40 is deflected slightly toward the inner surface 30 by the reinforcement portion 44 when the extension 42 is received into the detent 48. Advantageously, the inclusion of the extension 42 and detent 48 aids in preventing the slippage of the clip 10 from the open end of the bag 12 when such is inserted between the inwardly biased first and second jaw portions 14,24.

In the preferred embodiment, the front end 16 of the first jaw portion 14 which extends forwardly from the reinforcement portion 44 is angled outwardly away from the front end 26 of the second jaw portion 24. Advantageously, the rearwardly angled configuration of the front end 26 and the outwardly angled configuration of the front end 16 cause the outer surface 26*a* of the front end 26 and the inner surface 16*a* of the front end 16 to define an angled channel which aids in the insertion of the open end of the bag 12 between the inwardly biased front ends 16,26 and more particularly, the reinforcement portion 44 and the second spring portion 40. In using the clip 10, the compression of the back ends 18, 28 overcomes the biasing force exerted by the first spring portion 34 and separates the reinforcement portion 44 and second spring portion 40 from each other. Thereafter, the open end of the bag 12 is inserted between the reinforcement and second spring portions 44, 40 and the back ends 18,28 released, thus allowing the first spring portion 34 to bias the reinforcement and second spring portions 44,40 inwardly toward each other. In this respect, the open end of the bag 12 is maintained in a closed state by the abutment of the reinforcement portion 44 and second spring portion 40 thereagainst. The clamping force exerted on the open end of the bag 12 is significantly increased by the second spring portion 40 which is itself biased toward the reinforcement portion 44.

In the preferred embodiment, the clip 10 is fabricated from polypropylene to provide the same with a desired amount of resiliency, though it will be recognized that alternative resilient materials may also be utilized. Advantageously, due to the inclusion of the second spring portion 40 in addition to the first spring portion 34, the clip 10 is provided with added resiliency as well as added clamping force when secured to the bag 12 or a similar article. In addition to the added resiliency facilitated by the incorporation of the first and second spring portions 34, 40, the clip 10 is adapted to maintain such resiliency over prolonged periods of time, even when maintained in an open position. Further, since both the first and second spring portions 34, 40 are integrally formed as part of the clip 10, the clip 10 is less susceptible to breakage as commonly occurs with prior art clamping devices incorporating independent spring members in their construction.

Additional modifications and improvements of the present invention may also be apparent to those skilled in the art. Thus, the particular combination of parts described and illustrated herein is intended to represent only one embodiment of the invention, and is not intended to serve as limitations of alternative devices within the spirit and scope of the invention.

What is claimed is:

1. A bag clip comprising:

a first elongate jaw portion defining front and back ends and inner and outer surfaces;

a second elongate jaw portion defining front and back ends and inner and outer surfaces;

a first spring portion extending between and interconnecting said first and second jaw portions intermediate said front and back ends, said first spring portion being configured to orient the front and back ends of the first and second jaw portions in juxtaposed relation and operable to bias the front ends toward each other; and an elongate second spring portion attached to the front end of said second jaw portion and extending inwardly toward said first spring portion in cantilevered relation to the inner surface of said second jaw portion, said second spring portion being operable to bias the front end of said second jaw portion toward the front end of said first jaw portion;

wherein the compression of the back ends of the first and second jaw portions toward each other is operable to overcome the biasing force exerted by said first spring portions and separate the front ends from each other.

2. The clip of claim 1 wherein said first spring portion has an arcuate configuration and is bowed outwardly toward the back ends of said first and second jaw portions.

3. The clip of claim 1 wherein the juxtaposed back ends of said first and second jaw portions have arcuate configurations and are bowed inwardly toward each other.

4. The clip of claim 3 wherein the back ends of said first and second jaw portions include a plurality of laterally extending ribs formed on the outer surfaces laterally extending ribs formed on the outer surfaces thereof to aid in the gripping of the back ends.

5. The clip of claim 3 further comprising a pair of reinforcing ribs extending along the inner surfaces of the back ends of said first and second jaw portions in opposed relation.

6. The clip of claim 1 further comprising a reinforcement portion formed on and extending along the inner surface of said first jaw portion in opposed relation to said second spring portion.

7. The clip of claim 6 wherein said second spring portion defines a proximal portion including an extension formed on and extending upwardly therefrom, and said reinforcement portion defines a proximal portion including a detent formed therein, said detent being sized and configured to receive said extension when said front ends are biased toward each other by said first and second spring portions.

8. The clip of claim 7 wherein the front end of said second jaw portion is angled rearwardly toward said first spring portion and the front end of said first jaw portion is angled outwardly away from the front end of said second jaw portion.

9. The clip of claim 1 wherein said clip is fabricated from polypropylene.

* * * * *